US009040453B2

(12) United States Patent
Yamamuro et al.

(10) Patent No.: US 9,040,453 B2
(45) Date of Patent: May 26, 2015

(54) THERMAL TRANSFER IMAGE-RECEIVING SHEET AND MANUFACTURING METHOD FOR THERMAL TRANSFER IMAGE-RECEIVING SHEET

(75) Inventors: Koji Yamamuro, Tokyo (JP); Katsuyuki Hirano, Tokyo (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 30 days.

(21) Appl. No.: 14/004,005

(22) PCT Filed: Mar. 1, 2012

(86) PCT No.: PCT/JP2012/055200

§ 371 (c)(1), (2), (4) Date: Sep. 9, 2013

(87) PCT Pub. No.: WO2012/121096

PCT Pub. Date: Sep. 13, 2012

(65) Prior Publication Data

US 2013/0344261 A1 Dec. 26, 2013

(30) Foreign Application Priority Data

| | | |
|---|---|---|
| Mar. 7, 2011 | (JP) | 2011-049047 |
| Mar. 31, 2011 | (JP) | 2011-080192 |
| Feb. 6, 2012 | (JP) | 2012-023222 |
| Feb. 6, 2012 | (JP) | 2012-023302 |

(51) Int. Cl.
*B41M 5/382* (2006.01)
*B41M 5/44* (2006.01)
(Continued)

(52) U.S. Cl.
CPC ..... *B41M 5/506* (2013.01); *B41M 5/38214* (2013.01); *B41M 5/52* (2013.01);
(Continued)

(58) Field of Classification Search
CPC .... B41M 5/382; B41M 5/38214; B41M 5/41; B41M 5/42; B41M 5/44; B41M 5/50; B41M 5/506; B41M 5/508; B41M 5/52; B41M 2205/02; B41M 2205/32; B41M 2205/38
USPC ..... 503/227
See application file for complete search history.

(56) References Cited

U.S. PATENT DOCUMENTS 7,638,462 B2 12/2009 Kawamura et al.
7,745,374 B2 * 6/2010 Tanaka et al. ..... 503/227
(Continued)

FOREIGN PATENT DOCUMENTS

EP 0540991 10/1992
EP 1655144 5/2006
(Continued)

OTHER PUBLICATIONS

International Search Report, PCT/JP2012/055200, May 22, 2012.
(Continued)

*Primary Examiner* — Bruce H Hess
(74) *Attorney, Agent, or Firm* — Young & Thompson

(57) ABSTRACT

Disclosed is a thermal transfer image-receiving sheet which excels in adhesiveness to a receiving layer and solvent resistance, and a manufacturing method thereof. In the thermal transfer image-receiving sheet, which includes a porous layer, a barrier layer, a receiving layer which are stacked in this order on a substrate, the porous layer includes a binder resin and hollow particles, and the barrier layer includes (i) (A) a first acrylic resin and (B) one or more kinds of resins selected from the group consisting of polyester resins, polyvinyl pyrrolidone type resins, polyester type urethane resin, and a second acrylic resin which differs from the first acrylic resin; or (ii) a polyvinyl pyrrolidone type resin.

9 Claims, 1 Drawing Sheet

(51) Int. Cl.
*B41M 5/50* (2006.01)
*B41M 5/52* (2006.01)

(52) U.S. Cl.
CPC ..... *B41M 2205/02* (2013.01); *B41M 2205/06* (2013.01); *B41M 2205/32* (2013.01); *B41M 2205/36* (2013.01); *B41M 2205/38* (2013.01); *B41M 5/44* (2013.01)

(56) References Cited

U.S. PATENT DOCUMENTS

2008/0299334 A1 12/2008 Tsukada et al.
2009/0087552 A1 4/2009 Koide et al.

FOREIGN PATENT DOCUMENTS

| | | |
|---|---|---|
| EP | 1747898 | 1/2007 |
| EP | 2000319 | 12/2008 |
| JP | 2008-296485 | 12/2008 |
| JP | 2009-096197 | 5/2009 |
| JP | 2010-158901 | 7/2010 |

OTHER PUBLICATIONS

Extended European search report, dated Sep. 3, 2014, in corresponding European Patent Application No. 12755420.0.

* cited by examiner

THERMAL TRANSFER IMAGE-RECEIVING SHEET AND MANUFACTURING METHOD FOR THERMAL TRANSFER IMAGE-RECEIVING SHEET

FIELD OF TECHNOLOGY

The present invention relates to a thermal transfer image-receiving sheet and a manufacturing method for the thermal transfer image-receiving sheet, particularly to a thermal transfer image-receiving sheet which has a barrier layer which shows an excellent adhesiveness to a receiving layer and has an excellent solvent resistance, and a manufacturing method for the thermal transfer image-receiving sheet.

BACKGROUND ARTS

Currently, a sublimation transfer recording method is known, wherein a thermal transfer sheet in which a sublimation type dye is supported on a substrate made of a plastic film or the like, and a thermal transfer image-receiving sheet in which a receiving layer is provided on a substrate made of a paper, a plastic film or the like are superposed to form a full color image. Since this method uses the sublimation type dye as a color material, it is possible to adjust freely the density and the gradation dot unit by dot unit, a full-color image can be clearly expressed as the original image on the image-receiving sheet. Therefore, this method has been applied in the color image formation for digital cameras, video recorders, computers or the like. Its image can rival silver halide photography with high quality.

In order to obtain good printing properties on the thermal transfer image-receiving sheet to be used for the sublimation transfer recording method, it is known that it is preferable to give heat resistance and cushioning to the thermal transfer image-receiving sheet. With regard to the functional requirements for the heat resistance and the cushioning, a thermal transfer image-receiving sheet in which a foamed film such as a polypropylene film having micro-voids is laminated onto the substrate and the receiving layer is provided on the foamed film has been proposed. However, this thermal transfer image-receiving sheet will have problems such that the foamed film shrinks by heat on the formation of the receiving sheet and thus curls. Thus, the studies for providing a novel functional layer having the heat resistance and the cushioning functions, and the studies for a thermal transfer receiving sheet in which a laminated film such as the foamed film is not used in order to eliminate the curl due to the thermal history during the manufacturing process have been made. For example, Patent Document 1 proposes a thermal transfer image-receiving sheet which is provided with a porous layer instead of the foamed film, wherein the porous layer is formed by using a coating liquid which contains hollow particles and a binder.

Incidentally, since the hollow particles contained in the porous layer is soluble to the solvent, in the case that the receiving layer is formed on the porous layer with using an organic solvent-type coating liquid, the porous layer is destroyed. Because the hollow particles are dissolved in the solvent. Thus, the functionality as the porous layer is no longer maintained. Under such a situation, a thermal transfer receiving sheet in which a barrier layer made of polyvinyl alcohol is provided between a porous layer and a receiving layer has been also proposed, said polyvinyl alcohol is known as a resin having a high solvent resistance. It is said that the destruction of the porous layer's functionality by the solvent can be prevented when the thermal transfer receiving sheet having this barrier layer is adopted.

PRIOR ART DOCUMENTS

Patent Document

Patent Document 1: Japanese Unexamined Patent Publication No. 2008-296485

SUMMARY OF THE INVENTION

Problems to be Solved by the Invention

However, the barrier layer composed of polyvinyl alcohol embraces a problem that the polyvinyl alcohol has a poor adhesiveness with the resin used for the receiving layer, and thus an adverse effect is caused in the adhesion between the barrier layer and the receiving layer. Although attempts to add a certain ingredient of improving the adhesiveness into the barrier layer which comprises the polyvinyl alcohol has been made, however, the solvent resistance of the barrier layer becomes lower as the ingredient of improving the adhesiveness is added. At present, therefore, no barrier layer in which the solvent resistance and the adhesiveness to the receiving layer can be compatible with each other is known in the art.

The present invention has been accomplished in view of this situation, a main object of the present invention is to provide a thermal transfer image-receiving sheet which has a barrier layer of an excellent adhesiveness to the receiving layer and an excellent solvent resistance, and a manufacturing method for the thermal transfer image-receiving sheet.

Means for Solving the Problems

The present invention for solving the above problems relates to a thermal transfer image-receiving sheet, which comprises a porous layer, a barrier layer, a receiving layer which are stacked in this order on a substrate, wherein the porous layer comprises a binder resin and hollow particles, wherein the barrier layer comprises (i) (A) a first acrylic resin and (B) one or more kinds of resins selected from the group consisting of polyester resins, polyvinyl pyrrolidone type resins, polyester type urethane resin, and a second acrylic resin which differs from the first acrylic resin; or (ii) a polyvinyl pyrrolidone type resin.

In addition, the first acrylic resin may be a core-shell type acrylic resin. In addition, a blending ratio of the first acrylic resin and the one or more kinds of resins selected from the group (B) may be in the range of 9:1 to 5:5 on the basis of their solid content ratio.

In addition, the polyvinyl pyrrolidone type resin may be a cross-linked polyvinyl pyrrolidone type resin. Further, the cross-linked polyvinyl pyrrolidone type resin may be the one that is cross-linked at a ratio in the range of 40% to 50% by parts in one molecule.

A method according to the present invention in order to solve the above problems is a method for manufacturing a thermal transfer image-receiving sheet which comprises a porous layer, a barrier layer, a receiving layer which are stacked in this order on a substrate, wherein a step for forming the barrier layer comprises coating an aqueous coating solution onto the substrate and drying the coated solution, wherein the aqueous coating solution includes (A) a first acrylic resin and (B) one or more kinds of resins selected from the group consisting of polyester resins, polyvinyl pyrrolidone type resins, polyester type urethane resin, and a second acrylic resin which differs from the first acrylic resin.

In addition, the first acrylic resin may be of a core-shell type acrylic resin. In addition, the first acrylic resin and the second acrylic resin may be acrylic resin emulsions which differ from each other in the minimum film-forming temperature. Further, a blending ratio of the first acrylic resin and the (B) one or more kinds of resins selected from the group consisting of the polyester resins, the polyvinyl pyrrolidone type resins, the polyester type urethane resin, and the second acrylic resin which differs from the first acrylic resin in the aqueous coating solution may be in the range of 9:1 to 5:5 on the basis of their solid content ratio.

Effect of the Invention

The thermal transfer image-receiving sheet according to the present invention can be provided with a barrier layer which excels in the solvent resistance and the adhesiveness to the receiving layer. Further, the method for manufacturing a thermal transfer image-receiving sheet according to the present invention can produce the barrier layer which composes a part of the thermal transfer image-receiving sheet according to the present invention with a good coating suitability.

EMBODIMENTS FOR CARRYING OUT THE INVENTION

Figure 1:
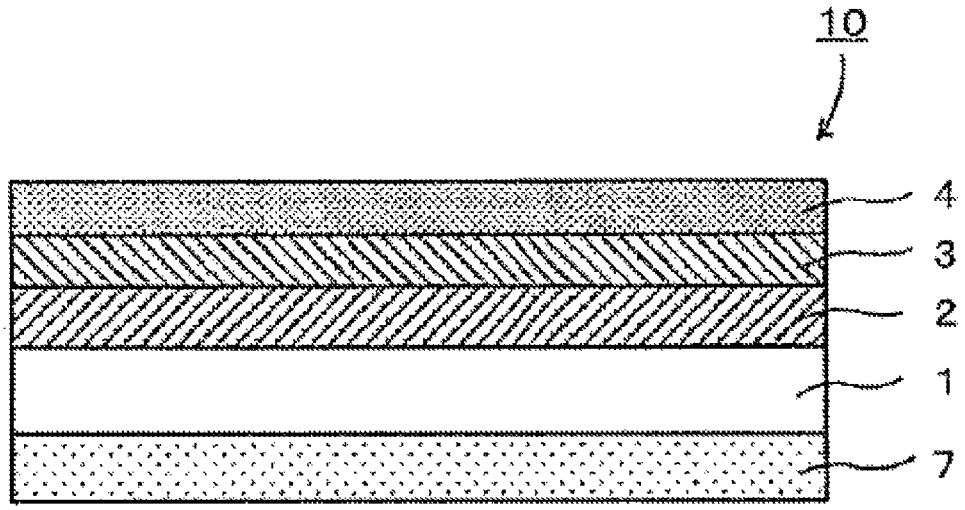
FIG. 1 is a schematic sectional view showing a layered structure of the thermal transfer image-receiving sheet according to the present invention.

Hereinafter, the thermal transfer image-receiving sheet 10 according to the present invention will be specifically described with reference to the drawings. As shown in FIG. 1, the thermal transfer image-receiving sheet 10 of the present invention takes a structure where a porous layer 2, a barrier layer 3, and a receiving layer 4 are layered in this order on a substrate 1. Hereinafter, the present invention will be specifically described.

(Substrate)

The substrate 1 is an essential component of the thermal transfer image-receiving sheet 10 of the present invention, and it is provided for the purpose of supporting the porous layer 2. The substrate 1 is not particularly limited, and may be composed of an arbitrarily material including: stretched or unstretched plastic films, such as, plyesters of having high heat resistance such as polyethylene terephthalate and polyethylene naphthalate, polypropylenes, polycarbonates, cellulose acetates, poly ethylene derivatives, polyamides, polymethyl pentene and so on; and papers, such as, fine quality papers, coated papers, art papers, cast coated papers, paperboard and so on. Further, it is also possible to use a composite film in which two or more of these materials are laminated.

Although the thickness of the substrate 1 can be appropriately selected depending on the kind of the material used so as to make it suitable in strength, heat resistance and so on, the thickness is usually in the range of about 1 μm-about 300 μm, and, preferably in the range of about 60 μm-about 200 μm.

(Porous Layer)

As shown in FIG. 1, on the substrate 1, the porous layer 2 is provided. The porous layer 2 is an essential component of the thermal transfer image-receiving sheet 10 of the present invention, and the porous layer fulfills heat resistance quality for preventing the substrate 1 from damage by heat when the heat applied to the receiving layer 4 from a thermal head is transferred to the substrate 1, and cushioning quality for preventing the density unevenness and the phenomena in which white spots (blown-out) are caused at high-light portions on the image formation. Then, in the present invention, the porous layer 2 contains hollow particles in order to give the heat resistance quality and the cushioning quality to the porous layer 2. Hereinafter, the porous layer 2 which comprises the hollow particles and a binder resin will be mainly described.

The heat resistance quality of the porous layer 2 can be adjusted as appropriate by varying the thickness of the porous layer 2, the amount of the hollow particles contained in the porous layer 2, i.e., the porosity of the porous layer 2. Among them, from a viewpoint of giving an adequate thermal insulation property, the thickness of the porous layer 2 is preferably in the range of 10 μm-100 μm, more preferably in the range of 10 μm-50 μm. In this case, the density of the porous layer 2 is preferably in the range of 0.1 g/cm$^3$-0.8 g/cm$^3$, more preferably in the range of 0.2 g/cm$^3$-0.7 g/cm$^3$.

In addition, the porosity of the porous layer 2 is preferably in the range of 15% to 80%. It should be noted that the porosity as hereinbefore mentioned is the value which is calculated from the formula: (the porosity of the hollow particles)×(the content of the hollow particles in the porous layer).

Further, the porous layer 2 may have a single layer structure or have a multi-layered structure in which a plurality of layers is layered. Herein, as the porous layer 2 that has the multi-layered structure, it is possible to use the one in which a plurality of layers which have a same composition mutually are layered, or alternatively, another one in which a plurality of layers which have mutually different composition are layered. Particularly, when the structure in which two layers that have mutually different compositions are layered are adopted, it is possible to give a functional porous layer 2, and thus, it is preferable.

The hollow particles contained in the porous layer 2 give the thermal insulation and cushioning functions to the porous layer 2. Therefore, with regard to the hollow particles, it is possible to make an appropriate selection to impart desired heat insulation and cushioning properties to the porous layer 2, and thus, foamed particles may be used, or, alternatively, non-foamed particles may be also used. Furthermore, the foamed particles as used for the hollow particles can be closed-cell particles, or open-cell particles. Moreover, the hollow particles may be organic hollow particles which are constituted by a resin or the like, or may be inorganic hollow particles the hollow particles which are constituted by glass or the like. In addition, the hollow particles may be cross-linked hollow particles.

As the resin constituting the hollow particles includes, for example, styrene type resins such as styrene-acrylic resin, cross-linked styrene-acrylic resin; (meth)acrylic resins such as acrylonitrile-acrylic resin; phenolic resins; fluorine containing resins; polyamide type resins; polyimide type resins, polycarbonate type resins; polyether type resins, and so on.

The average particle diameter of the hollow particles can be set as appropriate in accordance with the kind of resin which constitutes the hollow particles, and thus there is no particular limitation, but is generally preferably in the range of 0.1 μm-15 μm, and particularly preferably in the range of 0.1

μm-10 μm. This is because, when the average particle diameter is too small, the amount of the hollow particles increases, and the cost increases. On the other hand, when the average particle diameter is too large, it becomes difficult to form a smooth porous layer 2.

In the present invention, the amount of the hollow particles contained in the porous layer 2 can be set as appropriate as far as desired heat insulation and cushioning functions can be obtained, and thus there is no particular limitation. However, the amount of the hollow particles is preferably set in the range of 30% by weight to 90% by weight, and more preferably set in the range of 50% by weight to 80% by weight, on the basis that the total solid content included in the porous layer 2 is 100% by weight. This is because, when the amount is too small, the voids in the porous layer 2 are reduced, and thus, there is a possibility that sufficient insulation and cushioning properties cannot be obtained. On the other hand, when the amount is too large, the weight ratio of the binder resin becomes smaller in inverse proportion to the increment of the amount of the hollow particles, and thus, there is a possibility that the porous layer 2 becomes brittle and the formability of the layer deteriorates.

The binder resin is not particularly limited, but is usually preferred to be an aqueous resin which can be dispersed or dissolved in an aqueous solvent. As such aqueous resin, for example, polyurethane resins such as acrylic urethane resins; polyester resins; gelatins; styrene acrylate copolymers; polyvinyl alcohols; polyethylene oxides; polyvinyl pyrrolidones; pullulan; carboxymethyl methyl celluloses; hydroxyethyl celluloses; dextran; dextrin; polyacrylic acid and salts thereof; agars; κ-carrageenan; λ-carrageenan; ι-carrageenan; casein; xanthan gum; locust bean gum; alginic acid; gum arabic; polyalkylene oxide type copolymers; water-soluble polyvinyl butyrals; homopolymer or copolymer of carboxyl group or sulfonic acid group-containing vinyl monomer, etc., can be enumerated. Further, any combination of two or more of the above mentioned resins is also usable. Herein, when using a material, such as gelatin, polyvinyl alcohol, agar, κ-carrageenan, λ-carrageenan, ι-carrageenan or the like, as the binder resin, these binder resins can also exert a cooling gelation function. Therefore, it is possible to form a good porous layer without using an additional cooling gelling agent as mentioned later.

In the present invention, the amount of the binder resin contained in the porous layer 2 can be determined as appropriate depending on the kind of the hollow particles used, the thermal insulation property required for the thermal image-receiving sheet 10, conditions for image formation, etc. In general, the ratio of the binder resin is preferably set in the range of 5% by weight to 70% by weight, more preferably set in the range of 10% by weight to 60% by weight, and particularly preferably set in the range of 15% by weight to 45% by weight, on the basis that the total solid content included in the porous layer 2 is 100% by weight. This is because, when the content of the binder resin is too small, there is a fear that the porous layer 2 becomes brittle and the formability of the layer deteriorates. On the other hand, when the amount of the binder resin is too large, there is a fear that the content of the hollow particles is not sufficiently ensured and the intended purpose of obtaining the thermal insulation property and the cushioning property in the porous layer 2 is not ensured.

In the present invention, it is preferable that the hollow particles and the binder resin are contained within their individual ranges as described above. Particularly, it is preferable that PV ratio is in the range of 8/2 to 4/6. By containing the hollow particles and a binder resin so as to satisfy the PV ratio of the above range, it becomes possible to improve further the thermal insulation property of the porous layer 2, and to prevent effectively the occurrence of burning. It should be noted that, herein, the "PV ratio" is defined as a value calculated from the formula: (the weight of the solid content of the hollow particles)/(the weight of the solid content of the resins). Wherein, the "resins" means both of the hollow particles and the binder, and thus, the weight of the solid content of the resins means the total of the weight of the solid content of the hollow particles and the weight of the solid content of the binder resin.

Further, it is preferable that a cooling gelling agent is contained in the porous layer 2, instead of the binder resin, or in combination with the binder resin. By containing the cooling, it becomes possible to give a more excellent heat insulation property to the porous layer 2.

With regard to the cooling gelling agent, it is possible to select appropriately one from conventionally known cooling gelling agents and use it. For instance, gelatin, polyvinyl alcohol, agar, κ-carrageenan, λ-carrageenan, ι-carrageenan, fruit glue, etc., can be enumerated as the cooling gelling agent.

Further, in the present invention, in the case of containing the cooling gelling agent, instead of the binder resin, or in combination with the binder resin, the blending ratio of the hollow particles and the cooling gelling agent contained in the porous layer 2 is not particularly limited, as far as a porous layer 2 which has a desired thermal insulation property can be formed. However, the content of the cooling gelling agent is preferably set in the range of 5 parts by weight to 50 parts by weight, more preferably set in the range of 10 parts by weight to 40 parts by weight, and particularly preferably set in the range of 12 parts by weight to 40 parts by weight, per 100 parts by weight of the solid content included in a porous layer forming liquid. By setting the blending ratio of the hollow particles and the cooling gelling agent within the above range, a porous layer 2 having an excellent heat insulation property can be formed.

Further, the porous layer 2 may optionally include a surfactant such as nonionic silicone type surfactants, a curing agent such as isocyanate compounds, a wetting agent, a dispersing agent, etc.

The porous layer 2 can be formed by coating a porous layer forming liquid onto the substrate 1 in accordance with a conventionally known procedure such as the gravure printing method, the screen printing method, the reverse coating method which uses a gravure roll, or the like, and then drying the coated liquid, wherein the porous layer forming liquid is prepared by dispersing or dissolving the hollow particles described above, the binder resin and/or the cooling gelling agent, and any optionally adding other ingredient(s) described above, in an aqueous solvent.

(Barrier Layer)

As shown in FIG. 1, on the porous layer 2, the barrier layer 3 is provided. According to the present invention, the barrier layer 3 comprises (i) (A) a first acrylic resin and (B) one or more kinds of resins selected from the group consisting of polyester resins, polyvinyl pyrrolidone type resins, polyester type urethane resin, and a second acrylic resin which differs from the first acrylic resin; or (ii) a polyvinyl pyrrolidone type resin. Hereinafter, the barrier layer containing (i) (A) the first acrylic resin and (B) one or more kinds of resins selected from the group consisting of the polyester resins, the polyvinyl pyrrolidone type resins, the polyester type urethane resin, and the second acrylic resin which differs from the first acrylic resin is also referred to as "barrier layer of the first embodiment", and the barrier layer containing (ii) the polyvinyl pyrrolidone type resin is also referred to as "barrier layer of the second embodiment".

According to the barrier layer 3 of the first embodiment and the barrier layer 3 of the second embodiment, an excellent solvent resistance can be attained, while an excellent adhesiveness to the porous layer 2 and the receiving layer 4 can be also attained. Therefore, it becomes possible to prevent the porous layer 2 from destruction which is due to a solvent for forming the receiving layer 4, and it becomes possible that the porous layer 2 adheres to the receiving layer 4 firmly. Hereinafter, the barrier layer of the first embodiment, and the barrier layer of the second embodiment will be described.

Barrier Layer of the First Embodiment

The barrier layer 3 of the first embodiment includes (i) (A) the first acrylic resin and (B) one or more kinds of resins selected from the group consisting of the polyester resins, the polyvinyl pyrrolidone type resins, the polyester type urethane resin, and the second acrylic resin which differs from the first acrylic resin. Now, the ingredients included in the barrier layer of the first embodiment will be specifically described.

(First Acrylic Resin)

In the barrier layer of the first embodiment, the first acrylic resin is included as an essential constituent component. Among various resinous components, the acrylic resin is excellent in solvent resistance and adhesion. Therefore, through the addition of the first acrylic resin in the barrier layer 3, the solvent resistance and the adhesion property is given to the barrier layer 3. In the present invention, the first acrylic resin is included in the barrier layer 3, with a principal view to improving the solvent resistance of the barrier layer 3.

With regard to an acrylic resin used as the first acrylic resin, there is no particular limitation, and the solvent resistance can be given to the barrier layer 3 irrespective of the kind of the any acrylic resin. The acrylic resin used as the first acrylic resin may be an acrylic resin (in a narrow sense), or one of acrylic derivatives such as methacrylic resin, etc. In the present invention, as the first acrylic resin, for instance, polymethyl methacrylate, polyacrylamide, acrylic polyol resin, styrene-acrylic copolymer or the like is preferably used.

Among a variety of acrylic resins, any of core-shell type acrylic resins can be particularly preferably used in the present invention. The core-shell type acrylic resin has an extremely superior solvent resistance property owing to its structural characteristics. Thus, by using the core-shell type acrylic resin as the first acrylic resin, the barrier layer 3 can be improved dramatically in its solvent resistance. Note that, the term "core-shell type acrylic resin" used herein is not limited to the ones in which both of the core part and the shell part consist of acrylic resin(s), but also involves the ones in which one of the core part and the shell part consists of acrylic resin. For example, the core-shell type acrylic resin may be the one in which the core part is made of an acrylic resin, and the shell part is made of a polyurethane type resin.

Further, in the present invention, the first acrylic resin is preferably an acrylic resin prepared from an acrylic resin emulsion, and is particularly preferably a core-shell type acrylic resin prepared by heating a core-shell type acrylic resin emulsion at a temperature of not less than its minimum film-forming temperature. By using an acrylic resin emulsion, the barrier layer 3 of the first embodiment can be formed with enjoying a good coating suitability.

The acrylic resin emulsion to be used may be appropriately selected from conventionally known acrylic resin emulsions. The acrylic resin emulsion may be prepared by adding acrylic resin particles to water in conjunction with a surfactant while mixing, or by being directly synthesized from acrylic monomer(s) in accordance with a conventionally known emulsion polymerization method. As the acrylic resin emulsion, any of commercially available products is also usable, for instance, a core-shell type acrylic resin emulsion (manufactured by Mitsui Chemicals, Inc., Barrier-Star (registered trademark) B-1000, the weight ratio of the core part:the shell part=1:1.5, the solid content of 20%), of which shell part consists of an acryl amide type resin (glass transition temperature: 218° C.) and the core part consists of an acrylic resin (glass transition temperature: 10° C.); and other Barrier-Star (registered trademark) series (B-1000, B-1500, B-2000, B-3000, B-4100), manufactured by Mitsui Chemicals, Inc., are preferably usable.

As the acrylic resin emulsion, it is preferable to have a solid content in the range of 20% by weight to 50% by weight, more preferably, in the range of 30% by weight to 50% by weight. By using the acrylic resin emulsion the solid content of which is within the above range, the barrier layer 3 of the first embodiment can be formed with enjoying a good coating suitability.

Further, With regard to the first acrylic resin emulsion for obtaining the first acrylic resin, it is preferable to have a minimum film-forming temperature of not more than 15° C. By adopting as the first acrylic resin an acrylic resin which is obtained from the acrylic resin emulsion having a minimum film-forming temperature of not more than 15° C., it becomes possible to impart a rapid film forming property on drying to the barrier layer obtained. Accordingly, when the barrier layer contains the first acrylic resin which is obtained from the acrylic resin emulsion having a minimum film-forming temperature of not more than 15° C., and one or more kinds of resins selected from the group consisting of the polyester resins, the polyvinyl pyrrolidone type resins, the polyester type urethane resin, and the second acrylic resin as described later, it is possible to form the barrier layer 3 which is excellent in its adhesion and solvent resistant properties. Particularly, it is preferable that the first acrylic resin is the core-shell type acrylic resin which is obtained from the core-shell type acrylic resin emulsion having a minimum film-forming temperature of not more than 15° C. As the core-shell type acrylic resin emulsion having a minimum film-forming temperature of not more than 15° C., for instance, an acrylic resin emulsion manufactured by Mitsui Chemicals Inc., Barrier-Star (registered trademark) B-4100 (minimum film-forming temperature: 5° C.) and so on can be enumerated.

The "minimum film-forming temperature" used herein refers to the temperature at which the formation of a transparent layer is fully completed on the condition that an acrylic resin emulsion is thinly coated on a metal plate such as aluminum or stainless steel plate and then temperature is allowed to increase. In the temperature range below the minimum film-forming temperature, the transparent layer cannot be formed, but a white powdery state is obtained.

(Polyester Resins, Polyvinyl Pyrrolidone Type Resins, Polyester Type Urethane Resin, Second Acrylic Resin)

The first acrylic resin is contained for the purpose to improve the solvent resistance of the barrier layer, and, in the above description, the core-shell type acrylic resin is enumerated as a preferred example. Although the core-shell type acrylic resin has an extremely excellent solvent resistance property, but, in general, it is inferior to acrylic resins other than the core-shell type in the adhesion property. Thus, in the case that the core-shell type acrylic resin which excels predominantly in the solvent resistance is used as the first acrylic resin, it is necessary to make up for the shortage of adhesion property of the barrier layer 3 by other ingredient(s).

Thus, in addition to the first acrylic resin, the barrier layer 3 of the first embodiment also includes one or more kinds of resins selected from the group consisting of the polyester resins, the polyvinyl pyrrolidone type resins, the polyester type urethane resin, and the second acrylic resin, as resin(s) for giving an excellent adhesion property to the barrier.

<Polyester Resin>

With regard to the polyester resin, it is possible to select appropriately one from conventionally known polyester resins and use it. In the present invention, the preferably used is polyester resin having a number average molecular weight (Mn) of 5,000 or more, and the particularly preferably used is polyester resin having a Mn of 15,000 or more. By using the polyester resin having a number average molecular weight in the above range, the heat resistance of the barrier layer 3 can be improved. In order to prevent the hollow particles contained in the porous layer 2 from destruction due to the solvent used for the formation of the barrier layer, the polyester resin is preferably the type of water-soluble or water-dispersible. Herein, the number average molecular weight (Mn) of the polyester resin is the one that is determined in accordance with the GPC/MALLS method.

Further, considering the heat resistance, it is preferable that the polyester resin has a glass transition temperature (Tg) of 50° C. or more.

<Polyvinyl Pyrrolidone Type Resin>

Polyvinyl pyrrolidone type resin may be a homopolymer of a vinyl pyrrolidone monomer such as N-vinyl-2-pyrrolidone, N-vinyl-4-pyrrolidone, namely polyvinyl pyrrolidone, or may be a copolymer of vinyl pyrrolidone monomer and other monomer(s). As the other monomer, it is preferably a vinyl monomer.

As the vinyl monomer, for instance, vinyl ethers such as cyclohexyl vinyl ether, ethyl vinyl ether, hydroxyethyl vinyl ether, hydroxybutyl vinyl ether, hydroxyethyl vinyl ether, etc.; fatty acid vinyl esters such as vinyl acetate, vinyl lactate, etc.; (meth)acrylic esters such as methyl(meth)acrylate, ethyl (meth)acrylate, hydroxyethyl(meth)acrylate, hydroxypropyl (meth)acrylates, etc.; and allyl ethers such as hydroxybutyl allyl ether, ethylene glycol monoallyl ether, etc.; can be enumerated. As the copolymer of vinyl pyrrolidone and other vinyl monomer(s), any commercially available products can be utilized. For instance, as the commercially available products of vinyl pyrrolidone-vinyl acetate copolymer, Rubiscol VA28 and Rubiscol VA73, each manufactured by BASF, etc., can be enumerated.

In addition, as the polyvinyl pyrrolidone type resin, polymers which each includes pyrrolidone derivative(s) having substituent(s) in its pyrrolidone ring, such as, N-vinyl-3-methylpyrrolidone, N-vinyl-5-methylpyrrolidone, N-vinyl-3,3,5-trimethylpyrrolidone, N-vinyl-3-benzyl-pyrrolidone, etc., can be also enumerated.

Among the above exemplified polyvinyl pyrrolidone type resins, homopolymers of vinyl pyrrolidone, that is, polyvinyl pyrrolidone resins are particularly preferable in the present invention. Among various polyvinyl pyrrolidone type resins, the polyvinyl pyrrolidone resins excel particularly in the solvent resistance and the adhesiveness.

In the case that the polyvinyl pyrrolidone type resin is one of the above-described copolymers of vinyl pyrrolidone and other monomer(s), it is preferable that the vinyl pyrrolidone content in the copolymer is not less than 30%, and more preferably, not less than 50%. When the vinyl pyrrolidone content in the copolymer is set to 50% or more, it becomes possible to attain an excellent solvent resistance and an excellent adhesiveness of the barrier layer. Incidentally, the solvent resistance and the adhesiveness tend to decrease, with the degree of downward deviation from the vinyl pyrrolidone content in the copolymer of 30%.

With regard to the polyvinyl pyrrolidone type resin, it is preferable to use the one that has a Fikentscher K-value of not less than 30 or more resin, particularly, to use the one of K-15 grade to K-120 grade. When considering this point, the polyvinyl pyrrolidone type resin preferably has a number average molecular weight (Mn) in the range of 8000 to 3000000. Herein, the number average molecular weight (Mn) of the polyvinyl pyrrolidone type resin is the one that is determined in accordance with the GPC/MALLS method.

Further, in the present invention, a cross-linked polyvinyl pyrrolidone type resin in which polyvinyl pyrrolidone type resin is cross-linked is particularly preferably used. The cross-linked polyvinyl pyrrolidone type resin excels in heat resistance, in addition to the solvent resistance, and the adhesiveness. Therefore, even when an image printing of high gradation region is performed, that is, an image printing is performed under a high energy, the possibility of occurring charred materials on the printed matter can be precluded by the adoption of the cross-linked polyvinyl pyrrolidone type resin in the barrier layer.

The cross-linked polyvinyl pyrrolidone type resin may be the one in which all parts of a molecule is cross-linked, or may be the one that is cross-linked partially. In the present invention, the one in which 10 to 70% parts per a molecule is cross-linked, especially, 40% to 50% parts per a molecule is cross-linked is preferably usable. As the cross-linked polyvinyl pyrrolidone type resin, it is possible to use a commercially available one, for example, VIVIPRINT540 @ polymerolymer (ISP INVESTMENTS INC Corporation), etc., can be used preferably.

The cross-linked polyvinyl pyrrolidone type resin can be obtained by cross-linking a polyvinyl pyrrolidone resin linear polymer with a carboxyl group-containing compound or the like via a hydrogen bond, an ionic bond or the like. As the carboxyl group-containing compound, for instance, poly (meth)acrylic acid and/or (meth)acrylic acid copolymers can be enumerated. It should be noted that the compound to be used to the cross-linking is not limited to the carboxyl group-containing compounds, but compounds each having a functional group other than carboxyl group may be also usable. For example, as a cross-linked polyvinyl pyrrolidone type resin, it is possible to use a compound prepared in accordance with a method disclosed in the Japanese Unexamined Patent Publication No. 2001-524998. As a preferred cross-linking agent, a compound obtained by reacting methylene bis(acryl amide) (MBAR) with piperazine (PA) may be enumerated.

<Polyester Type Polyurethane Resin>

The polyester type polyurethane resin may be obtained, for instance, by reacting a polyester polyol with a diisocyanate compound. More concretely, as the polyester type polyurethane resin, linear block copolymers which each is obtained by reacting a polyester polyol which is obtained by a polycondensation reaction of a glycol such as ethylene glycol, propylene glycol, neopentyl glycol, 1,6-hexanediol, etc, and a dibasic acid such as adipic acid, isophthalic acid, terephthalic acid, etc., with an isocyanate such as tolylene diisocyanate, hexamethylene diisocyanate, 4,4'-diphenylmethane diisocyanate, may be enumerated.

In addition, from the same viewpoint as described above, the polyester type urethane resin is preferably water-soluble or water-dispersible one.

(Second Acrylic Resin)

The second acrylic resin may be any acrylic resin as far as it differs from the first acrylic resin, and thus it can be appropriately selected from acrylic resins other than the first acrylic resin to be used. Herein, "the second acrylic resin differs from the first acrylic resin" may include: (1) the case that the first acrylic resin and the second acrylic resin differ in their structures; (2) the case that the first acrylic resin and the second acrylic resin differ in their physical properties even if they have a common structure; (3) the case that the first acrylic resin and the second acrylic resin differ in their starting materials, etc.

As the case (1), for example, a case that the first acrylic resin is an acrylic resin and the second resin is a styrene-acrylic copolymer or the like; and a case that the first acrylic resin is a core-shell type acrylic resin and the second acrylic resin is an acrylic resin other than the core-shell type acrylic resin can be enumerated.

As the case (2), for example, a case that the first acrylic resin has a glass transition temperature of 10° C., and the second acrylic resin has a glass transition temperature of 32° C. can be enumerated.

As the case (3), for example, a case that the first acrylic resin and the second acrylic resin are obtained from their individual acrylic resin emulsions which have mutually different minimum film-forming temperatures. In this case, it is preferable that the minimum film-forming temperature of the second acrylic resin emulsion for obtaining the second acrylic resin is higher than the minimum film-forming temperature of the first acrylic resin emulsion for obtaining the first acrylic resin, and the minimum film-forming temperature of the second acrylic resin emulsion is particularly preferable to be more than 15° C. More preferably, it is desirable that the first acrylic resin is an acrylic resin which is obtained from an acrylic resin emulsion having a minimum film-forming temperature of lower than 15° C., and the second acrylic resin is an acrylic resin which is obtained from an acrylic resin emulsion having a minimum film-forming temperature of not lower than 15° C. According to this combination, it is possible to obtain a barrier layer of which the adhesion to the barrier layer and the solvent resistance are particularly excellent.

As the acrylic resin emulsion having a minimum film-forming temperature of not less than 15° C., for instance, an acrylic emulsion manufactured by DIC Co., Ltd., AK2100 (minimum film-forming temperature: 25° C.) can be enumerated.

As described above, the core-shell type acrylic resin is exemplified as a preferred embodiment of the first acrylic resin. While the core-shell type acrylic resin has an extremely excellent solvent resistance property, it is inferior to acrylic resins other than the core-shell type in the adhesion property, as mentioned above. Considering this point, the second acrylic resin is preferably to be an acrylic resin other than the core-shell type one.

When using as the first acrylic resin a core-shell type acrylic resin, and using as the second acrylic resin an acrylic resin other than the core-shell type one, an excellent solvent resistance can be given to the barrier layer 3 through the first acrylic resin, and a sufficient adhesion property which is not fully compensated by the first acrylic resin can be given to the barrier layer 3 through the second acrylic resin other than the core-shell type one.

With regard to the barrier layer 3 of the first embodiment, the blending ratio of (A) the first acrylic resin and the (B) one or more kinds of resins selected from the group consisting of the polyester resins, the polyvinyl pyrrolidone type resins, the polyester type urethane resin, and the second acrylic resin is preferably in the range of 9:1 to 5:5 on the basis of their solid content ratio. By compounding (A) the first acrylic resin and the (B) one or more kinds of resins selected from the group consisting of the polyester resins, the polyvinyl pyrrolidone type resins, the polyester type urethane resin, and the second acrylic resin within this blending ratio, a barrier layer which excels in both the solvent resistance and the adhesion property can be formed.

Further, the above described polyester resin, polyvinyl pyrrolidone type resin, the polyester type urethane resin, and the second acrylic resin may be used singly or may be used in their any combination.

Further, the barrier layer 3 of the first embodiment may contain other ingredients as necessary. For example, it may contain additives such as fluorescent whitening agent and a white pigment such as titanium oxide. In addition, it is possible to use other resin(s), for instance, polyvinyl alcohol resin, cellulose derivatives and the like, in addition to the above mentioned (A) and (B) resins.

With regard to the barrier layer 3 of the first embodiment, the total weight of the first acrylic resin and the one or more kinds of resins selected from the group consisting of the polyester resins, the polyvinyl pyrrolidone type resins, the polyester type urethane resin, and the second acrylic resin is preferably in the range of not less than 60% by weight, on the basis of the total solid content by weight in the barrier layer 3. When the total weight of these resins is less than 60% by weight, on the basis of the total solid content by weight in the barrier layer 3, the solvent resistance and the adhesion property tend to decrease. As for the upper limit of this total weight, there is no particular limitation, and it may take a value of 100% by weight.

The barrier layer 3 of the first embodiment may be formed by preparing a coating solution wherein the first acrylic resin as the one type of resins as mentioned above, and one or more of the polyester resin, the polyvinyl pyrrolidone type resin, the polyester type urethane resin, and the second acrylic resin as another type of resins, and optionally, other resin(s) and/or additive(s), are dissolved or dispersed in an aqueous solvent such as water, and coating this coating solution in accordance with a conventionally known procedure such as the gravure printing method, the screen printing method, the reverse coating method which uses a gravure roll, or the like.

With regard to the thickness of the barrier layer 3 of the first embodiment, there is no particular limitation. When the coating amount on drying is less than 0.2 g/m$^2$, the solvent resistance or the adhesion property may tend to decrease. Therefore, considering this point, the barrier layer 3 preferably has a thickness of about 0.2 g/m$^2$-about 5.0 g/m$^2$. Ditto for the thickness of the barrier layer 3 of the second embodiment described later.

Barrier Layer of the Second Embodiment

The barrier layer 3 of the second embodiment contains polyvinyl pyrrolidone type resin. The barrier layer 3 which contains the polyvinyl pyrrolidone type resin excels in the solvent resistance, as well as the adhesiveness to the porous layer 2 and the receiving layer 4. Therefore, when providing the barrier layer 3 which contains the polyvinyl pyrrolidone type resin between the porous layer 2 and the receiving layer 4, the first mode the same manner as the barrier layer, it becomes possible to prevent the porous layer 2 from destruction which is due to a solvent for forming the receiving layer 4, and it becomes possible to adhere the porous layer 2 and the receiving layer 4 firmly, as is the case of the barrier layer of the first embodiment.

As the polyvinyl pyrrolidone type resin to be contained in the barrier layer 3 of the second embodiment, those described above for the barrier layer 3 of the first embodiment 3 can be used in perfect analogy, thus, a detailed description about it is omitted here. In addition, the polyvinyl pyrrolidone type resin, or the cross-linked polyvinyl pyrrolidone type resin may be used singly, or they can be used in combination.

With regard to the content of the polyvinyl pyrrolidone type resin on the basis of the total solid content by weight in the barrier layer 3 of the second embodiment, although there is no particular limitation, but it is preferable to be in the range of not less than 50% by weight and not more than 100% by weight. When the content of the polyvinyl pyrrolidone type resin is not less than 50% by weight, the adhesion barrier layer 3 which particularly excels in the solvent resistance and the adhesion property can be formed.

Further, the barrier layer 3 of the second embodiment may contain other ingredients as necessary. For example, it may contain additives such as fluorescent whitening agent, a white pigment such as titanium oxide, and porous particles having solvent resistance. Further, the barrier layer 3 can also contain other resin component(s) without prejudice to the spirit and scope of the invention. For example, the polyvinyl pyrrolidone type resin may be used in combination with other resin component(s) such as acrylic resin, polyvinyl alcohol resin, cellulose derivative or the like. Further, for instance, when the polyvinyl pyrrolidone type resin is used in combination with anyone of acrylic resin, polyester resin and polyester type polyurethane resin, the adhesiveness can be further improved.

The barrier layer 3 of the second embodiment may be formed by preparing a coating solution wherein one of the polyvinyl pyrrolidone type resin and the cross-linked polyvinyl pyrrolidone type resin as described above, and optionally, other resin(s) and/or additive(s), are dissolved or dispersed in an aqueous solvent such as water, and coating this coating solution in accordance with a conventionally known procedure such as the gravure printing method, the screen printing method, the reverse coating method which uses a gravure roll, or the like.

(Receiving Layer)

As Shown in FIG. 1, a receiving layer 4 is provided on the barrier layer 3. The receiving layer 4 is an essential component of the thermal transfer image-receiving sheet 10 of the present invention. Onto the receiving layer 4, an image is formed by thermal transfer from a color material layer which is in the possession of a thermal transfer sheet in accordance with the thermal transferring method. As a material for forming the receiving layer 4, any resin material conventionally known as it can accept easily a thermally transferrable color material such as sublimation dye or thermally meltable ink, etc., can be used. Examples thereof include: polyolefin resins such as polypropylene, etc.; halogenated resins such as polyvinyl chloride, polyvinylidene chloride, etc.; vinylic resins such as polyvinyl acetate, vinyl chloride-vinyl acetate copolymer, ethylene-vinyl acetate copolymer, polyacrylic acid esters, etc.; polyester resins such as polyethylene terephthalate, polybutylene terephthalate, etc.; polystyrene type resins; polyamide type resins; copolymer type resins of olefin such as ethylene or propylene, and other vinyl monomer; ionomers; cellulose type resins such as cellulose diacetate; and polycarbonates. Among them, vinyl chloride type resins, acryl-styrene type resins, and polyester resins are particularly preferable.

The receiving layer 4 may be formed by preparing a coating solution for receiving layer wherein one or more materials selected from the above mentioned materials, and optionally, other various additive(s), are dissolved or dispersed in an appropriate solvent such as water or an organic solvent, coating this coating solution in accordance with a conventionally known procedure such as the gravure printing method, the screen printing method, the reverse coating method which uses a gravure roll, or the like, and then drying out the coated one. The thickness of the receiving layer is about 1-10 g/m$^2$ in the dry state.

(Filling Layer)

Figure 2:
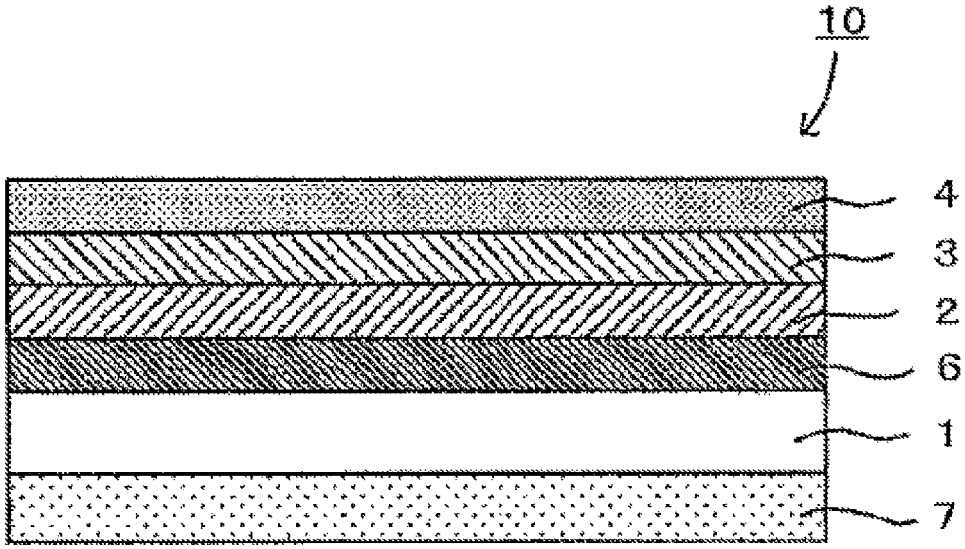
FIG. 2 is a schematic sectional view showing another layered structure of the thermal transfer image-receiving sheet according to the present invention.

Further, for instance, when a coated paper is used as the substrate 1, and the porous layer 2 is formed on the coated paper with using an aqueous coating liquid, the coated paper is compelled to absorb water, and which brings a fear that the thermal transfer image-receiving sheet 10 may curl up. Thus, when as the substrate 1 a substrate of high water absorption is used and the porous layer 2 is formed by using a water-based coating liquid, it is preferable that a filling layer 6 is provided between the substrate 1 and the porous layer 2 as shown in FIG. 2.

With regard to the filling layer 6, as far as it can produce a waterproof function, its material and other conditions are not particularly limited. For instance, it may be made of polyester resin, acrylic resin, acryl-urethane type resin, vinyl chloride resin or the like, or it may be formed from an emulsion such as (meth)acrylic acid alkyl ester homopolymer based emulsion, (meth)acrylic acid alkyl ester-styrene copolymer based emulsion, (meth)acrylic acid alkyl ester-vinyl acetate copolymer based emulsion, cement based filler containing emulsion or the like.

The thickness of the filling layer 6 is not particularly limited, but preferably, it is in the range of about 0.2 g/m$^2$-about 10.0 g/m$^2$.

(Back Layer)

Further, as shown in FIGS. 1 and 2, the thermal transfer image-receiving sheet according to the present invention may be equipped with a back layer 7 on the opposite side of the substrate 1 to the other side on which the receiving layer 4 is formed. With regard to the back layer 7, any one which has a desired function depending on the uses or others of the thermal transfer image-receiving sheet according to the present invention may be selected appropriately. Particularly, in the present invention, as the back layer 7, the one which has a function of improving transport of the thermal transfer image-receiving sheet, or the one which has a function of preventing the curl is desirably used.

As the material for constituting the back layer which has the above mentioned desirable transport-improving function or the curl-preventing function, as far as it can impart a desired transport property or curl prevention property, it is not particularly limited. In general, for instance, a material in which a filler as an additive is added in a binder resin which comprises an acrylic resin, a cellulosic resin, a polycarbonate resin, a polyvinyl acetal resin, a polyvinyl alcohol resin, a polyamide resin, a polystyrene type resin, a polyester type resin, a halogenated polymer or the like is used.

Although the thermal transfer image-receiving sheet according to the present invention has been described in detail as above, but the present invention is not limited to the above mentioned embodiments, and various modifications can be applied without deviating from the spirit and scope of the invention.

Hereinafter, the manufacturing method for the thermal transfer image-receiving sheet according to the present invention will be described. The manufacturing method for the thermal transfer image-receiving sheet is a method for manufacturing a thermal transfer image-receiving sheet which comprises a porous layer, a barrier layer, a receiving layer which are stacked in this order on a substrate, wherein a step for forming the barrier layer comprises coating an aqueous coating solution onto the substrate and drying the coated solution, wherein the aqueous coating solution includes (A) a first acrylic resin and (B) one or more kinds of resins selected from the group consisting of polyester resins, polyvinyl pyrrolidone type resins, polyester type urethane resin, and a second acrylic resin which differs from the first acrylic resin. Hereinafter, the (A) acrylic resin is also referred to as a "resin of ingredient A", the (B) one or more kinds of resins selected from the group consisting of the polyester resins, the polyvinyl pyrrolidone type resins, the polyester type urethane resin, and the second acrylic resin is also referred to as "resin(s) of ingredient B".

Hereinafter, respective steps of the manufacturing method of the present invention will be described more specifically. It should be noted that there are no particular limitations with respect to the step for forming the porous layer and the step for forming the protective layer, and, for instance, they may be formed according to the forming methods as described above in relation to the thermal transfer image-receiving sheet of the present invention. Accordingly, the manufacturing method of the present invention will be described with particular emphasis on the step for forming the barrier layer.

(Barrier Layer Forming Step)

The step for forming the barrier layer is a step which is performed by coating an aqueous coating solution containing the resin of ingredient A and the resin(s) of ingredient B on the porous layer 3, and drying up the coated solution to form the barrier layer.

The manufacturing method according to the present invention, a barrier layer having an excellent solvent resistance and an excellent adhesiveness to the receiving layer can be formed.

Moreover, in the manufacturing method of the present invention, the barrier layer is formed by using an aqueous coating solution, therefore, the formation of the barrier layer does not damage the porous hollow particles contained in the layer. Therefore, the thermal transfer image-receiving sheet is provided with adequate cushioning and durability. Further, in the case that an acrylic resin emulsion is used as the ingredient A or as one embodiment of the ingredient B to form the barrier layer, since the coating solution contains the acrylic resin emulsion, the barrier layer can be formed with enjoying a good coating suitability.

(Resin of Ingredient A)

As the first acrylic resin as the ingredient A, any conventionally known acrylic resin can be used. The first acrylic resin used in the barrier layer 3 of the thermal transfer image-receiving sheet according to the present invention can be used as it is as the acrylic resin of the ingredient A, therefore, a detailed description about it is omitted here.

Further, as explained above, it is preferable that the acrylic resin of the ingredient A included in the aqueous coating liquid is a core-shell type acrylic resin. In addition, it is also preferable that the acrylic resin of the ingredient A is an acrylic resin emulsion, and more particularly, it is a core-shell type acrylic resin emulsion. The acrylic resin emulsion may be prepared by adding and mixing acrylic resin particles to water in conjunction with a surfactant, or by being directly synthesized from acrylic monomer (s) in accordance with a conventionally known emulsion polymerization method.

Further, With regard to the acrylic resin emulsion as an embodiment of the ingredient A, it is preferable to have a minimum film-forming temperature of not more than 15° C. By using the acrylic resin emulsion which has a minimum film-forming temperature within the above-mentioned range, it becomes possible to form a barrier layer with a good coating suitability. Further, when it is used in combination with the ingredient B as described later, it becomes possible to form a barrier layer which excels in the adhesiveness to the receiving layer, and in the solvent resistance.

With regard to the acrylic resin emulsion as an embodiment of the ingredient A, it is preferable to have a solid content in the range of 20% by weight to 50% by weight, more preferably, in the range of 30% by weight to 50% by weight. By using the acrylic resin emulsion the solid content of which is within the above range, it becomes possible to form a barrier layer with enjoying a good coating suitability. As the acrylic resin emulsion the solid content of which is within the range of 20% by weight to 50% by weight, for instance, an acrylic resin emulsion manufactured by Mitsui Chemicals Inc., Barrier-Star (registered trademark) B-4100 (minimum film-forming temperature: 5° C.) and so on can be enumerated. Since this core-shell type acrylic resin emulsion has a minimum film-forming temperature of about 5° C., it is particularly preferred as the ingredient A.

(Resins of Ingredient B)

With regard to polyester resin, polyvinyl pyrrolidone type resin, polyester type urethane resin that are the resins of the ingredient B, those which are described above for the thermal transfer image-receiving sheet according to the present invention above can be used as they are, and therefore, a detailed descriptions about them are omitted here.

With regard to the second acrylic resin, as long as it satisfies the condition that it is different from the first acrylic resin, it may be appropriately selected from the above described acrylic resins to be used as the second acrylic resin. Herein, the feature that "the second acrylic resin differs from the first acrylic resin" may include the cases of (1)-(3), etc., as described above, in relation to the second acrylic resin of the thermal transfer image-receiving sheet 10 according to the present invention.

In the manufacturing method of the present invention, it is preferable that the first acrylic resin and the second acrylic resin are acrylic resin emulsions which have mutually different minimum film-forming temperatures. Particularly, a combination of an acrylic resin emulsion having a minimum film-forming temperature of lower than 15° C. as the first acrylic resin and another acrylic resin emulsion having a minimum film-forming temperature of not lower than 15° C. as the second acrylic resin is preferable. When using this combination, According to this combination, it is possible to obtain a barrier layer of which the adhesion to the barrier layer and the solvent resistance are particularly excellent. Further, the second acrylic resin is preferably to be an acrylic resin other than the core-shell type one, and more preferably to be an acrylic resin emulsion other than the core-shell type acrylic resin emulsion.

In addition, considering the coating suitability, it is preferable that the second acrylic resin emulsion is the one that has a solid content in the range of 20% by weight to 50% by weight, as is the case with the first acrylic resin emulsion.

(Bending Ratio)

The blending ratio of the resin of the ingredient A and the resin(s) of the ingredient B in the aqueous coating liquid is preferably in the range of 9:1 to 5:5 on the basis of their solid content ratio. By setting the blending ratio of the resin of the ingredient A and the resin(s) of the ingredient B within this range, a barrier layer which excels in both the solvent resistance and the adhesiveness to the receiving layer can be formed.

In addition to the ingredient A and the ingredient B, the aqueous coating liquid may contain other ingredients as necessary. For example, it may contain additives such as fluorescent whitening agent, a white pigment such as titanium oxide, polyvinyl alcohol resin, cellulose derivatives and the like, although the other ingredients are not particularly limited.

The total solid content of the resin of the ingredient A and the resin (s) of the ingredient B is preferably in the range of not less than 60% by weight, on the basis of the total solid content by weight in the aqueous coating liquid. When the total solid content of the resin of the ingredient A and the resin(s) of the ingredient B is less than 60% by weight, on the basis of the total solid content by weight in aqueous coating liquid, the solvent resistance and the adhesion property tend to decrease. As for the upper limit of the total solid content of the resin of the ingredient A and the resin(s) of the ingredient B, there is no particular limitation, and it may take a value of 100% by weight.

(Aqueous Solvent)

In the manufacturing method of the present invention, the barrier layer is formed with using an aqueous coating liquid, therefore, the resins of the ingredient A and the ingredient B are present in the aqueous coating liquid in the state that they are dispersed or dissolved in an aqueous solvent. Herein, the "aqueous solvent" refers to a solvent which comprises water as a main ingredient. The water content in the aqueous solvent is usually not less than 60% by weight, preferably, not less than 70% by weight, and more preferably not less than 80% by weight. As a solvent other than water, for instance, alcohols such as methanol, ethanol, isopropanol, n-propanol, etc.; glycols such as ethylene glycol, diethylene glycol, glycerol, etc.; esters such as, ethyl acetate, propyl acetate, etc.; ketone such as acetone, methyl ethyl ketone etc.; amides such as N,N-dimethylformamide, etc.; which do not easily cause phase separation in the coexistence with water, can be enumerated. As organic solvent, any liquids which consist of organic compounds which cause phase separation in the coexistence with water can be enumerated.

(Coating of Aqueous Coating Liquid)

With regard to the coating method for the aqueous coating liquid in which resins of the ingredient A and the ingredient B, and optionally, other ingredient(s) are dispersed or dissolved in the aqueous solvent, there is no particular limitation, and it can be selected appropriately from conventionally known coating methods, and the selected method is put into practice. For example, the aqueous coating solution can be coated on the porous layer in accordance with a conventionally known coating procedure such as the gravure printing method, the screen printing method, the reverse coating method which uses a gravure roll, or the like.

With regard to the coating amount of the aqueous coating liquid, there is no particular limitation. When the coating amount on drying is less than 0.2 g/m$^2$, the solvent resistance or the adhesion property may tend to decrease. Therefore, considering this point, the coating amount for the barrier layer 3 is preferably to be in the range of about 0.2 g/m$^2$-about 5.0 g/m$^2$ in the dried condition.

Hereinafter, the thermal transfer image-receiving sheet and the manufacturing method for the thermal transfer image-receiving sheet according to the present invention will be described concretely with referring to Examples and Comparative Examples. Herein, the simplified expressions of "%" and "part(s)" in this specification mean "% by weight" and "part(s) by weight", respectively.

EXAMPLE 1

As the substrate, RC paper (STF-150, manufactured by Mitsubishi Paper Mills, 190 μm) was availed. On this substrate, a liquid for forming porous layer having the following composition was coated so as to obtain a thickness of 8-10 g/m$^2$ in the dried state, and thereby a porous layer was formed. Subsequently, a liquid 1 for forming barrier layer having the following composition was coated on the porous layer so as to obtain a thickness of 1.0 g/m$^2$ in the dried state, and thereby a barrier layer was formed. Next, a liquid for forming receiving layer having the following composition was coated on the barrier layer so as to obtain a thickness of 2.5 g/m$^2$ in the dried state, and thereby a receiving layer was formed. Ultimately, a thermal transfer image-receiving sheet of Example 1 in which the substrate/the porous layer/the barrier layer/the receiving layer were layered in the order was prepared.

| <Liquid for forming porous layer> | |
|---|---|
| Hollow particles (average particle size: 1 μm) (HP-91, manufactured by Rohm and Haas, Ltd.) | 70 parts |
| Styrene acrylate (SX1707A, manufactured by Japan Zeon Co., Inc.) | 30 parts |
| Water | 10 parts |

| <Liquid 1 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: polyvinyl pyrrolidone resin (solid content: 12%) ((VIVI PRINT540), manufactured by ISP Japan Corp.) | 77 parts |
| Solid content ratio (A):(B) = 8:2 | |
| Water | 30 parts |
| IPA | 24 parts |

| <Liquid for forming receiving layer> | |
|---|---|
| Vinyl chloride - vinyl acetate copolymer (manufactured by Nissin Chemical Industry Co., Ltd, and marketed under the trade name: SOLBIN C) | 60 parts |
| Epoxy-modified silicone (manufactured by Shin-Etsu Chemical Co., Ltd., and marketed under the trade name: X-22-3000T) | 1.2 parts |
| Methyl styrene-modified silicone (manufactured by Shin-Etsu Chemical Co., Ltd., and marketed under the trade name: X-24-510T) | 0.6 parts |
| Methyl ethyl ketone/toluene (weight ratio: 1/1) | 5 parts |

EXAMPLE 2

A thermal transfer image-receiving sheet of Example 2 was obtained by carrying out the same procedure in Example 1 except that the liquid 1 for forming the barrier layer was replaced by a liquid 2 for forming the barrier layer having the following composition.

| <Liquid 2 for forming barrier layer> | |
|---|---|
| A: acrylic emulsion (solid content: 37%) (B-4100, manufactured by Mitsui Chemicals, Inc.) | 100 parts |
| B: polyvinyl pyrrolidone resin (solid content: 12%) ((VIVI PRINT540), manufactured by ISP Japan Corp.) | 206 parts |
| Solid content ratio (A):(B) = 6:4 | |
| Water | 21 parts |
| IPA | 16 parts |

EXAMPLE 3

A thermal transfer image-receiving sheet of Example 3 was obtained by carrying out the same procedure in Example 1 except that the liquid 1 for forming the barrier layer was replaced by a liquid 3 for forming the barrier layer having the following composition.

| <Liquid 3 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: polyester resin (solid content: 20%) (POLYESTER-WR-905, manufactured by Nippon Synthetic Chemical Industry Co., Ltd.) | 46 parts |
| Solid content ratio (A):(B) = 8:2 | |
| Water | 48 parts |
| IPA | 37 parts |

EXAMPLE 4

A thermal transfer image-receiving sheet of Example 4 was obtained by carrying out the same procedure in Example 1 except that the liquid 1 for forming the barrier layer was replaced by a liquid 4 for forming the barrier layer having the following composition.

| <Liquid 4 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: polyester resin (solid content: 20%) (POLYESTER-WR-905, manufactured by Nippon Synthetic Chemical Industry Co., Ltd.) | 123 parts |
| Solid content ratio (A):(B) = 6:4 | |
| Water | 48 parts |
| IPA | 37 parts |

EXAMPLE 5

A thermal transfer image-receiving sheet of Example 5 was obtained by carrying out the same procedure in Example 1 except that the liquid 1 for forming the barrier layer was replaced by a liquid 5 for forming the barrier layer having the following composition.

| <Liquid 5 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: Polyester polyurethane resin (solid content: 22.6%) (HYDRAN AP-40, manufactured by DIC Corporation) | 41 parts |
| Solid content ratio (A):(B) = 8:2 | |
| Water | 50 parts |
| IPA | 40 parts |

EXAMPLE 6

A thermal transfer image-receiving sheet of Example 6 was obtained by carrying out the same procedure in Example 1 except that the liquid 1 for forming the barrier layer was replaced by a liquid 6 for forming the barrier layer having the following composition.

| <Liquid 6 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: Polyester polyurethane resin (solid content: 22.6%) (HYDRAN AP-40, manufactured by DIC Corporation) | 110 parts |
| Solid content ratio (A):(B) = 6:4 | |
| Water | 67 parts |
| IPA | 52 parts |

EXAMPLE 7

A thermal transfer image-receiving sheet of Example 7 was obtained by carrying out the same procedure in Example 1 except that the liquid 1 for forming the barrier layer was replaced by a liquid 7 for forming the barrier layer having the following composition.

| <Liquid 7 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: acrylic emulsion (solids content: 45%, minimum film-forming temperature: 25° C.) (VONCOAT AK2100, manufactured by DIC Corporation) | 21 parts |
| Solid content ratio (A):(B) = 8:2 | |
| Water | 71 parts |
| IPA | 55 parts |

EXAMPLE 8

A thermal transfer image-receiving sheet of Example 8 was obtained by carrying out the same procedure in Example 1 except that the liquid 1 for forming the barrier layer was replaced by a liquid 8 for forming the barrier layer having the following composition.

| <Liquid 8 for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| B: acrylic emulsion (solids content: 45%, minimum film-forming temperature: 25° C.) (VONCOAT AK2100, manufactured by DIC Corporation) | 55 parts |
| Solid content ratio (A):(B) = 6:4 | |
| Water | 97 parts |
| IPA | 77 parts |

EXAMPLE 9

A thermal transfer image-receiving sheet of Example 9 was obtained by carrying out the same procedure in Example 1 except that the liquid 1 for forming the barrier layer was replaced by a liquid 9 for forming the barrier layer having the following composition.

| <Liquid 9 for forming barrier layer> | |
|---|---|
| Polyvinyl pyrrolidone resin (number average molecular weight: 60,000) (K-30, manufactured by ISP Japan Corp.) | 10 parts |
| Water | 90 parts |

EXAMPLE 10

A thermal transfer image-receiving sheet of Example 10 was obtained by carrying out the same procedure in Example 1 except that the liquid 1 for forming the barrier layer was replaced by a liquid 10 for forming the barrier layer having the following composition.

| <Liquid 10 for forming barrier layer> | |
|---|---|
| Polyvinyl pyrrolidone resin (number average molecular weight: 1,300,000) (K-90, manufactured by ISP Japan Corp.) | 10 parts |
| Water | 90 parts |

EXAMPLE 11

A thermal transfer image-receiving sheet of Example 11 was obtained by carrying out the same procedure in Example 1 except that the liquid 1 for forming the barrier layer was replaced by a liquid 11 for forming the barrier layer having the following composition.

| <Liquid 11 for forming barrier layer> | |
|---|---|
| Polyvinyl pyrrolidone resin (number average molecular weight: 3,000,000) (K-120, manufactured by ISP Japan Corp.) | 10 parts |
| Water | 90 parts |

EXAMPLE 12

A thermal transfer image-receiving sheet of Example 12 was obtained by carrying out the same procedure in Example 1 except that the liquid 1 for forming the barrier layer was replaced by a liquid 12 for forming the barrier layer having the following composition.

| <Liquid 12 for forming barrier layer> | |
|---|---|
| Cross-linked polyvinyl pyrrolidone resin (ViviPrint 540, manufactured by ISP Japan Corp.) | 10 parts |
| Water | 30 parts |

COMPARATIVE EXAMPLE 1

A thermal transfer image-receiving sheet of Comparative Example 1 was obtained by carrying out the same procedure in Example 1 except that the liquid 1 for forming the barrier layer was replaced by a liquid A for forming the barrier layer having the following composition.

| <Liquid A for forming barrier layer> | |
|---|---|
| A: acrylic emulsion (solid content: 37%, minimum film-forming temperature: 5° C.) (B-4100, manufactured by Mitsui Chemicals, Inc.) | 100 parts |
| Water | 27 parts |
| IPA | 21 parts |

COMPARATIVE EXAMPLE 2

A thermal transfer image-receiving sheet of Comparative Example 2 was obtained by carrying out the same procedure in Example 1 except that the liquid 1 for forming the barrier layer was replaced by a liquid B for forming the barrier layer having the following composition.

| <Liquid B for forming barrier layer> | |
|---|---|
| Polyester resin (solid content: 20%) (POLYESTER-WR-905, manufactured by Nippon Synthetic Chemical Industry Co., Ltd.) | 100 parts |

COMPARATIVE EXAMPLE 3

A thermal transfer image-receiving sheet of Comparative Example 3 was obtained by carrying out the same procedure in Example 1 except that the liquid 1 for forming the barrier layer was replaced by a liquid C for forming the barrier layer having the following composition.

| <Liquid C for forming barrier layer> | |
|---|---|
| Polyester polyurethane resin (solid content: 22.6%) (HYDRAN AP-40, manufactured by DIC Corporation) | 100 parts |
| Water | 20 parts |
| IPA | 15 parts |

COMPARATIVE EXAMPLE 4

A thermal transfer image-receiving sheet of Comparative Example 4 was obtained by carrying out the same procedure in Example 1 except that the liquid 1 for forming the barrier layer was replaced by a liquid D for forming the barrier layer having the following composition.

| <Liquid D for forming barrier layer> | |
|---|---|
| acrylic emulsion (solids content: 45%, minimum film-forming temperature: 25° C.) (VONCOAT AK2100, manufactured by DIC Corporation) | 100 parts |
| Water | 70 parts |
| IPA | 55 parts |

COMPARATIVE EXAMPLE 5

A thermal transfer image-receiving sheet of Comparative Example 5 was obtained by carrying out the same procedure in Example 1 except that the liquid 1 for forming the barrier layer was replaced by a liquid E for forming the barrier layer having the following composition.

| <Liquid E for forming barrier layer> | |
|---|---|
| Polyvinyl alcohol resin (PVA205, manufactured by Kuraray Co., Ltd.) | 10 parts |
| Water | 90 parts |

<<Evaluation of Adhesiveness>>

With regard to Examples 1 to 12 and Comparative Examples 1 to 5, an adhesive tape (Mending Tape, Product No.: MD-12, manufactured by Nichiban, Co., Ltd.) was once stuck on each individual receiving layer, and then the adhesive tape was peeled off from the receiving layer with the peel-off angle of 180°, and the evaluation of adhesiveness was performed in accordance with the following evaluation criteria. Evaluation results are shown in Table 1.

<Evaluation Criteria>

○ . . . The receiving layer is not peeled off.

x . . . The receiving layer is peeled off.

<<Evaluation of Barrier Property>>

Upon the formation of each individual thermal transfer image-receiving sheet of Examples 1 to 12 and Comparative Examples 1 to 5, a layered structure (the substrate/the porous layer/the barrier layer) which was an advance structure before the formation of the receiving layer was prepared. On the barrier layer of the layered structure, one drop of a mixed solution of methyl ethyl ketone and toluene was dropped, and it was wiped off 5 seconds after the dropping. The evaluation of barrier property was performed in accordance with the following evaluation criteria. The evaluation results are shown in Table 1.

<Evaluation Criteria>

◎ . . . No trace of the dropped solvent was observed.

○ . . . Although the trace of the dropped solvent can be seen, but it was no problem for performance.

x . . . The barrier layer suffered damages due to the solvent.

<<Evaluation of Chars>>

Using a sublimation type thermal transfer printer (manufactured by ALTECH ADS Corporation, model: MEGA-PIXEL III), a 18-level gray scale's gradation image having an RGB value of 15×n (n=0-17) was printed on each individual thermal transfer sheet of Examples 1 to 12 and Comparative Examples 1 to 5, and then, using an optical densitometer (manufactured by GretagMacbeth Corporation, Spectrolino), the optical reflection density of the image was determined. Subsequently, the density of the part to which the maximum energy was applied ($OD_{max}$) and the density of a part to which energy next to the maximum energy was applied was compared. With regard to this comparison, when the degression in the density of the $Od_{max}$ is observed, it means that the heat resistance of the barrier layer is low and thus there may be a possibility of causing chars. Concretely, the evaluation of chars was performed in accordance with the following evaluation criteria. The evaluation results are shown in Table 1.

<Evaluation Criteria>

○ . . . The density of $OD_{max}$ did not decrease, and there were no possibility of causing chars.

Δ . . . $OD_{max}$ was 1.7 or more, and it was laid in the level of causing no problem in practical use.

x . . . $OD_{max}$ is less than 1.7, and it bore a high possibility of causing chars, and problems in practical use would arise.

<<Evaluation of White-Spots in the Print>>

Intermediate gradation printing portions (the 128-level gray scale's portions) in each individual printed matter obtained in Examples 1 to 12 and Comparative Examples 1 to 5 were inspected visually with respect to the presence or absence of white spots (blown-out), and the evaluation of white-spots in the printed matter was performed in accordance with the following evaluation criteria. The evaluation results are shown in Table 1.

<Evaluation Criteria>

○ . . . No white-spot was observed.

Δ . . . Few white-spots were observed, but it was no problem for performance.

x . . . A perceptible quantity of white-spots were generated, and it would cause a problem for performance.

TABLE 1

| | Evaluation of adhesiveness | Evaluation of barrier property | Evaluation of white-spots | Evaluation of chars |
|---|---|---|---|---|
| Example 1 | ○ | ◎ | ○ | ○ |
| Example 2 | ○ | ◎ | ○ | ○ |
| Example 3 | ○ | ◎ | ○ | ○ |
| Example 4 | ○ | ○ | ○ | ○ |
| Example 5 | ○ | ○ | ○ | ○ |
| Example 6 | ○ | ○ | ○ | ○ |
| Example 7 | ○ | ◎ | ○ | ○ |
| Example 8 | ○ | ○ | ○ | ○ |
| Example 9 | ○ | ○ | ○ | Δ |
| Example 10 | ○ | ○ | ○ | Δ |
| Example 11 | ○ | ○ | ○ | Δ |
| Example 12 | ○ | ○ | ○ | ○ |
| Comparative Example 1 | X | ◎ | ○ | ○ |
| Comparative Example 2 | ○ | X | X | ○ |
| Comparative Example 3 | ○ | X | X | ○ |
| Comparative Example 4 | ○ | X | X | ○ |
| Comparative Example 5 | X | ○ | ○ | Δ |

As is clear from Table 1, it was demonstrated that the thermal transfer image-receiving sheets of Examples which each is provided with a barrier layer comprising the ingredient A: the first acrylic resin and the ingredient B: any of polyvinyl pyrrolidone resins, polyester type urethane resin and the second acrylic resins; and the thermal transfer image-receiving sheets of Examples which each is provided with a barrier layer comprising the polyvinyl pyrrolidone type resin excelled in the adhesiveness to the receiving layer and the solvent resistance. On the other hand, it was demonstrated that the thermal transfer image-receiving sheets of Comparative Examples 1-5 which each did not satisfy the component conditions of the present invention could not meet both of the adhesiveness and the solvent resistance.

Explanation of Numeric Symbols

1 . . . substrate
2 . . . porous layer
3 . . . barrier layer
4 . . . receiving layer
6 . . . filling layer
7 . . . back layer
10 . . . thermal transfer image-receiving sheet

The invention claimed is:

1. A thermal transfer image-receiving sheet, which comprises a porous layer, a barrier layer, a receiving layer which are stacked in this order on a substrate, wherein the porous layer comprises a binder resin and hollow particles, wherein the barrier layer comprises:

(i) (A) a first acrylic resin and (B) one or more kinds of resins selected from the group consisting of polyester resins, polyvinyl pyrrolidone type resins, polyester type urethane resin, and a second acrylic resin which differs from the first acrylic resin, wherein the first acrylic resin is a core-shell type acrylic resin; or (ii) a cross-linked polyvinyl pyrrolidone type resin.

2. The thermal transfer image-receiving sheet according to claim 1, wherein a blending ratio of the first acrylic resin and the one or more kinds of resins selected from the group (B) is in the range of 9:1 to 5:5 on the basis of their solid content ratio.

3. The thermal transfer image-receiving sheet according to claim 2, wherein the polyvinyl pyrrolidone type resin of (i) (B) is a cross-linked polyvinyl pyrrolidone type resin.

4. The thermal transfer image-receiving sheet according to claim 1, wherein the polyvinyl pyrrolidone type resin of (i) (B) is a cross-linked polyvinyl pyrrolidone type resin.

5. The thermal transfer image-receiving sheet according to claim 4, wherein the cross-linked polyvinyl pyrrolidone type resin is the one that is cross-linked at a ratio in the range of 40% to 50% by parts in one molecule.

6. A method for manufacturing a thermal transfer image-receiving sheet which comprises a porous layer, a barrier layer, a receiving layer which are stacked in this order on a substrate, wherein a step for forming the barrier layer comprises coating an aqueous coating solution onto the substrate and drying the coated solution, wherein the aqueous coating solution includes (A) a first acrylic resin and (B) one or more kinds of resins selected from the group consisting of polyester resins, polyvinyl pyrrolidone type resins, polyester type urethane resin, and a second acrylic resin which differs from the first acrylic resin, wherein the first acrylic resin is a core - shell type acrylic resin.

7. The method for manufacturing the thermal transfer image-receiving sheet according to claim 6, wherein the first acrylic resin and the second acrylic resin are acrylic resin emulsions which differ from each other in the minimum film-forming temperature.

8. The method for manufacturing the thermal transfer image-receiving sheet according to claim 7, wherein a blending ratio of the first acrylic resin and the (B) one or more kinds of resins selected from the group consisting of the polyester resins, the polyvinyl pyrrolidone type resins, the polyester type urethane resin, and the second acrylic resin in the aqueous coating solution is in the range of 9:1 to 5:5 on the basis of their solid content ratio.

9. The method for manufacturing the thermal transfer image-receiving sheet according to claim 6, wherein a blending ratio of the first acrylic resin and the (B) one or more kinds of resins selected from the group consisting of the polyester resins, the polyvinyl pyrrolidone type resins, the polyester type urethane resin, and the second acrylic resin in the aqueous coating solution is in the range of 9:1 to 5:5 on the basis of their solid content ratio.

* * * * *